US005312036A

United States Patent [19]

Trotter

[11] Patent Number: 5,312,036

[45] Date of Patent: May 17, 1994

[54] INSTANTANEOUS WATER HEATER WHICH INCLUDES SAFETY DEVICES SEPARATELY OR IN COMBINATION TO PREVENT THE EXPLOSION OF THE HEAT EXCHANGER IN THE EVENT OF AN EXCESSIVE HEATING OF THE WATER IN THE HEATING COIL AND TO SHUT-OFF THE FLOW OF GAS TO THE BURNER

[75] Inventor: Ursus Trotter, San Pablo 3770, Santiago, Chile

[73] Assignee: Ursus Trotter, Santiago, Chile

[21] Appl. No.: 810,417

[22] Filed: Dec. 20, 1991

[30] Foreign Application Priority Data

Sep. 13, 1991 [CL] Chile ..... 864-91

[51] Int. Cl.[5] ..... F22B 37/42

[52] U.S. Cl. ..... 236/21 B; 431/22

[58] Field of Search ..... 431/22, 76; 236/15 A, 236/21 R, 21 B, 20 R

[56] References Cited

U.S. PATENT DOCUMENTS

| | | | |
|---|---|---|---|
| 2,151,541 | 3/1939 | Waddell | 236/15 A X |
| 3,387,246 | 6/1968 | Grayson | 236/21 B |
| 3,843,049 | 10/1974 | Baysinger | 236/20 R |
| 3,918,880 | 11/1975 | Risse | 431/22 |
| 4,007,872 | 2/1977 | Branson et al. | 236/15 A |

*Primary Examiner*—William E. Wayner

*Attorney, Agent, or Firm*—Cushman, Darby & Cushman

[57] ABSTRACT

The invention provides an instantaneous water heater which includes safety devices separately or in combination to prevent the explosion of the heat exchanger in the event of an excessive heating of the water in the heating coil and to shut-off the flow of gas to the burner in the event the atmosphere surrounding the water heater presents a dangerous decrease of its oxygen content or an excess $CO/CO_2$ content, thus avoiding the risk of asphixiation or intoxication to the user. Additionally, the main gas flow control valve includes a settling chamber for separating the solid particles entrained in the combustible gas and preventing the obstruction of the internal gas passages in the gas control valve, as well as the plugging of the gas injectors of the pilot flame and/or burner nozzles. The invention also provides an improved gas control valve comprising a concentrical linear arrangement of several functional elements mounted on a common axis so as to eliminate the conventional levers, pivots an the like used in the prior art gas control valves thus providing a higher functional reliability and constructional simplicity.

15 Claims, 4 Drawing Sheets

INSTANTANEOUS WATER HEATER WHICH INCLUDES SAFETY DEVICES SEPARATELY OR IN COMBINATION TO PREVENT THE EXPLOSION OF THE HEAT EXCHANGER IN THE EVENT OF AN EXCESSIVE HEATING OF THE WATER IN THE HEATING COIL AND TO SHUT-OFF THE FLOW OF GAS TO THE BURNER

BACKGROUND OF THE INVENTION

The instantaneous water heaters, better known as "gas calefons", present several problems leading to deterioration risks of the apparatus when, for example, the water flow is drastically reduced and the gas flow control valve does not quickly operate which results in the over heating of the heating coil and an almost certain meltdown of the heating coil or even the explosion of the water heater. Another problem of a high potential risk to the user is the posibility of the heater operating in a closed and/or unventilated ambient area which in several opportunities has resulted in intoxication or asfixiation of the user sometimes resulting in death.

Another problem in the known water heaters is the obstruction of the inner passages of the gas valve and/or the operating difficulty of the valve spools due to the binding effect produced by the solid particles entrained in the combustible gas. A further problem in water heaters provided with water temperature themostatic control is the use of a plurality of pivots and levers for interconnecting the thermostatic element to the main gas control valve which makes the correct modulation of the gas flow difficult as a function of the amount of the water flowing through the heating coil and the temperature of the hot water discharge and further increases the manufacturing cost of the gas valve due to the difference machining steps and/or difficult mould casting of the valve body.

The object of the present invention is to provide an improved instantaneous water heater wherein the cited problems are eliminated by the use of known and conventional elements, which elements up to date have never been used in the prior art instantaneous water heaters.

The present invention provides:

a) A solution to the problem of the risk of an explosion of the heating coil due to excesive water heating, by means of a heat sensing element disposed inside the heating coil and activating an interrupting means connected in series to the electromagnetic actuator of the primary gas flow solenoid valve so that in the event the temperature inside the heating coil raises above a predetermined level the solenoid valve interrupts the gas flow thus shutting-off the water heater burner as well as the associated pilot flame and the water heater going to a fail-safe condition.

b) A solution to the problem of generation of an oxygen deficient atmosphere and/or high $CO—CO_2$ content atmosphere when the water heater operates in a closed or un-ventilated space through the provision of an "ambient analyzer" device which includes the pilot flame for heating the thermocuple that energizes the primary gas flow solenoid valve, said device mantaining the lighted pilot flame as long as the oxygen content of the ambient air is not decreased by more of 3%, the pilot flame being turned-off if the oxygen content is reduced below said level considered as unsafe or harmful to the human beings, said pilot flame light-off cooling the thermocouple and producing the inmediate shut-off of the solenoid gas valve thus turning-off the main burner and the pilot flame with the water heater going to a fail-safe condition.

c) A solution to the problem of entrainment and settling of the solid particles carried by the combustible gas, by the provision of a settling chamber positioned in the body of the gas control valve wherein the solid particles are separated by settling and are further retained by a screen filter.

d) A linear mounting and actuating arrangement between the manual gas closure/opening disk, the manual water temperature regulating means located in the exterior of the main control valve, and the thermostatic element responsive to the water temperature sensed by the thermostatic sensor bulb located inside the heat exchanger, thus eliminating the problems associated to the mechanical transmission by means of levers and simplifying the manufacturing process of the main control valve, which in turn reduces the manufacturing costs and increases the operating reliability of the valve.

BRIEF DESCRIPTION OF THE DRAWINGS

The invention will be deseribed with reference to the accompanying drawings, in which:

FIG. 1 schematically illustrates a portion of a gas flow control valve used in a gas fired instantaneous water heater which is provided with a gas inlet port 2, a solenoid cut-off protector valve 3 which is connected to a closure disk 4 seating against the pasage opening 5 leading to the main gas distributor chamber 6 of the gas valve body 1. The gas inlet 2 communicates with gas chamber 7 which bottom portion projects downwardly below the level of the gas inlet 2, so the the gas fed to the valve body 1 is able to expand with the corresponding velocity drop in bucket 8 of chamber 7. Additionally, the substantially particle free gas flows through a gas inlet filter 9 disposed intermediate the settling chamber 7 and passage 5 leading to the main gas distributor chamber 6 of gas control valve, thus enabaling the gas flowing to the burner FIG. 4, item 18*a* to be substantially clean and avoiding obstruction of the gas injectors of the burner and/or flame nossles as well as preventing any difficulty in the operation of the gas valve mechanism.

FIG. 2 illustrates the heating coil thermal protector (anti-explosion device). A thermal protector sensing bulb 10 is inserted through a suitable bushing 12 inside the heating coil 11 thus sensing the temperature of the heated water. The capillar tube 13 of the thermal protector sensing bulb 10 is provided with an actuator bellow 14 connected to a N.C. electric switch 15. Winding 16 of the solenoid cut off valve protector of the main gas valve switch is energized by the thermocouple (not shown in FIG. 2) by connecting cable 17 which is electrically connected to the input of the thermal protector N.C. electrical switch 15. The outlet of said switch is connected to the solenoid cut-off protector valve 3 and then to a common ground or to the metal frame of the water heater to close the activating electric circuit for solenoid cut off protector valve 3 a condition that is maintained while the temperature of the hot water circulating through heating coil 11 has not reached the preset operating temperature of the thermal protector sensing bulb 10.

Figure 2:
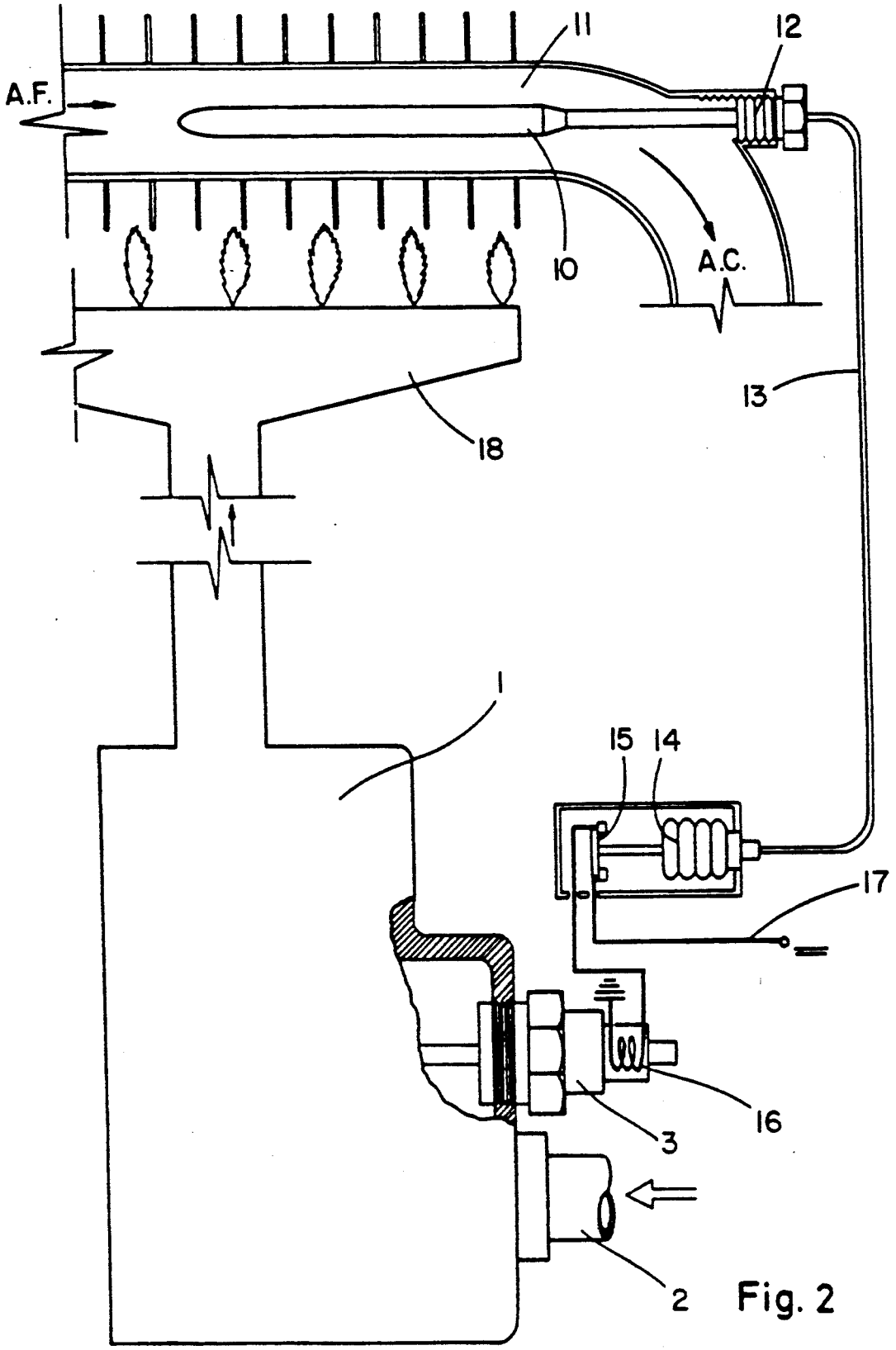
FIG. 2 schematically illustrates the heating coil inside of which is located a thermal protector which is an anti-explosion device connected to the solenoid cut-off protector gas valve, according to the invention.

In operation, the voltage generated by the thermocouple activated by the pilot flame (not shown in FIG. 2) energizes solenoid winding 16 of solenoid cut-off protector and valve 3 as the thermal protector N.C. switch 15 is closed due to the sensor thermal protector sensing bulb 10 being at a relatively low temperature. When solenoid cut-off protector valve 3 is energized combustible gas flows through inlet 2 into the gas control valve 1 flowing to the injector nozzles of the main burner where the gas ignites in a known manner.

Cold water AF circulating through heating coil 11 heats up and flows around thermal protector sensing bulb 10, increasing its temperature until it reaches the level preset by the user in the manual control (not shown) of the water heater. In the event the temperature of the hot water AC surrounding the thermostatic sensor 10 is higher than its preset factory limit, a signal generated by sensor 10 is transmited through the capillar tube 13 to operate thermal protector actuator bellow 14 to open the thermal protector N.C. switch 15 and interrupt the electrical feed to the solenoid cut-off protector valve 3.

Figure 1:
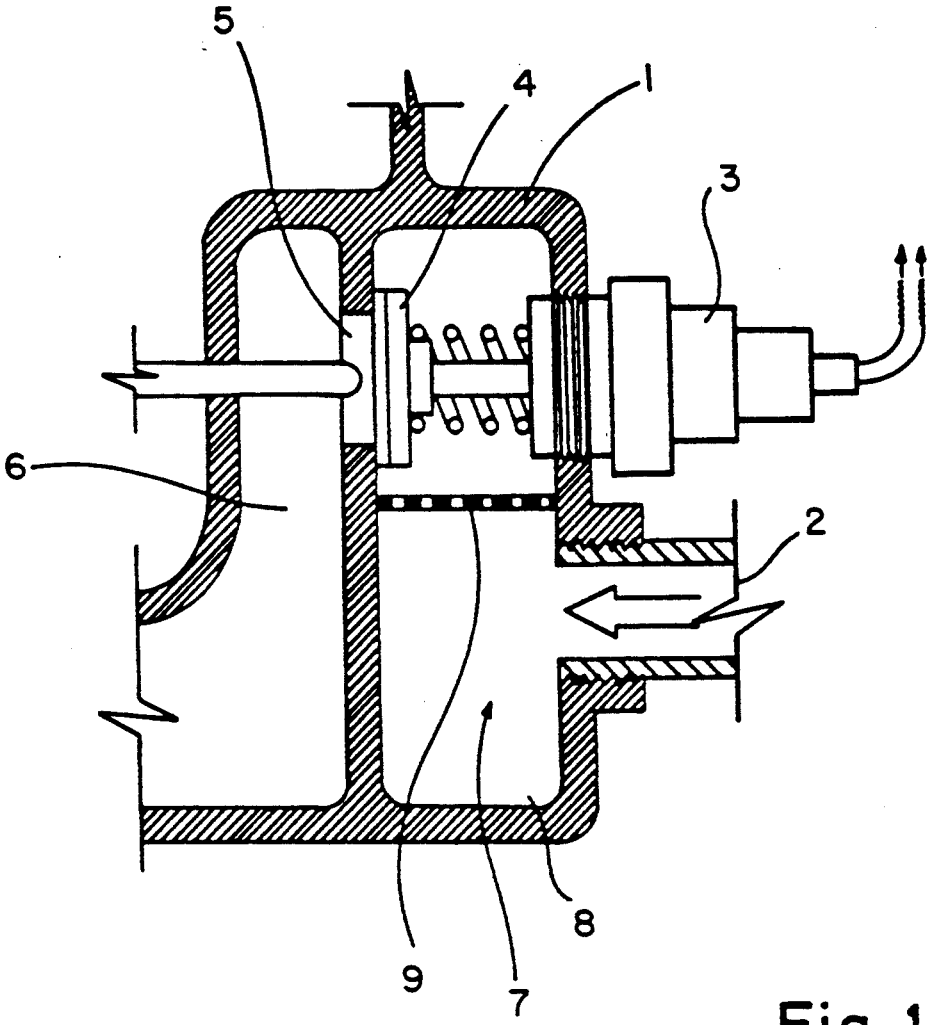
FIG. 1 is a fragmentary elevation, partially in section, schematically illustrating the way the gas flows through the valve, describing the gas inlet of the main control valve of an instantaneous water heater provided with the particle settling chamber according to the invention.

When the solenoid cut-off valve 3 is deactivated the flow of gas through the gas valve 1 (FIG. 1) is interrupted thus turning off burner 18 and allowing the over heated water flowing through the heating coil to cool-off.

Interruption of the gas flow through the main gas valve 1 turns-off the pilot flame (not shown) so that the thermocouple (not shown) cools-off and ceases to produce the voltage required to activate the solenoid cut-off protector valve 3. Thus, the instantaneous water heater is locked in a fail-safe condition even while the water flowing through the heating coil 11 becames cooler. Is is easily understood that the provision of such device, together with a convenient and suitable selection of the operating temperature of the sensor system totally prevents the possibility of an over heating and/or explosion of the heating coil of the instantaneous water heater.

Figure 3:
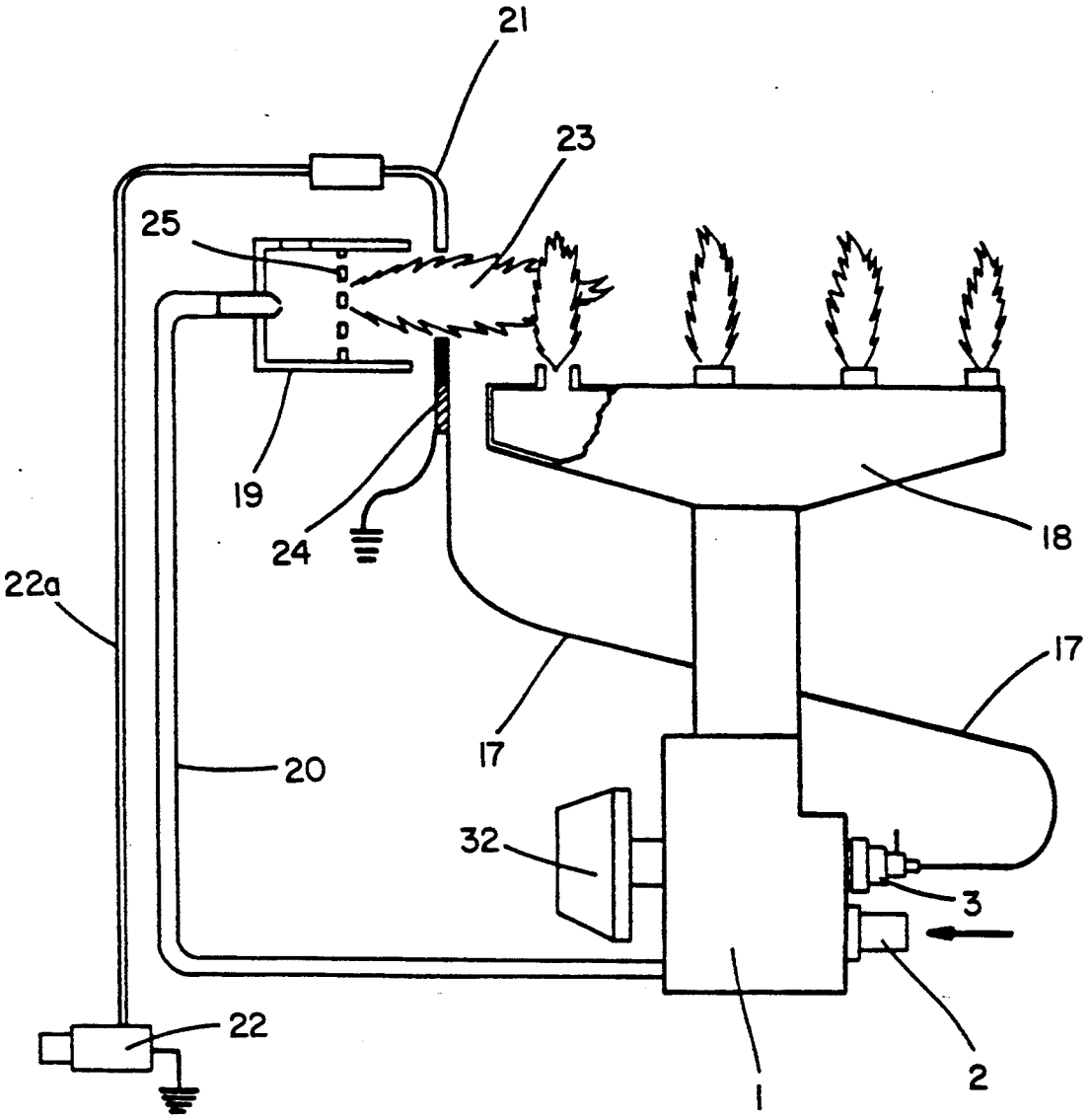
FIG. 3 schematically illustrates the ambient analyzer system which comprises the pilot flame nozzle, a thermocouple and a spark plug connected according to the invention to energize the solenoid cut-off protector gas valve through the thermocouple.

FIG. 3 schematically illustrates the ambient analyzer device 19 (oxyprotector), interconnected to the main gas control valve 1, the object of which is to turn-off burner 18 in the event of the ambient air around the water heater being is oxygen deficient for human existence (decreases 3% below its normal level).

A pilot flame injector nozzle 19 (oxyprotector which includes a thermocouple 24 and spark plug 21) is fed with combustible cut-off protector from the solenoid gas valve 3 by a gas pilot supply tube 20. An electrode 21 energized by a piezo-electric device 22 via a conductive cable **22*a* is suitably positioned facing the pilot flame 23. Near the pilot flame 23 is positioned a thermocouple 24 having a connecting cable 17 connected to the winding of the solenoid cut-off protector valve 3 so that the pilot flame 23 heats thermocouple 24 to generate the appropriate voltage for activating solenoid cut-off protector valve 3 to open the primary gas flow towards the burner 18 where the gas is ignited due to contact with the pilot flame 23**.

It is evident that if the pilot flame 23 turns off for any reason whatsoever the thermocouple will cool and will not generate the required voltage thus deactivating solenoid cut-off valve 3 and shutting-down the gas flow to the burner 18.

According to the invention the pilot flame device 19 comprises an atmosphere analyzer device that makes the flame separate from the thermocouple when the oxygen level drops 3% from its normal level. The atmosphere analyzer system corresponds to the "Model G.L.P.-OP 8001" marketed by OFFICINE DI PERNUMIA, S.A.S. (Via Rivella, Pernumia, Padova, Italy). The analyzer comprises, in a single body, the pilot with a connection means to the gas pilot supply tube 20 together with the the spark plug 21 and thermocouple 24.

In operation, the pilot flame 23 burns as long as the oxygen concentration in the surrounding air is at a normal level, which enables thermocouple 24 to mantain the energization of solenoid cut-off valve 3 in the open condition for the gas to flow to burner 18.

When the oxygen contents of the air around the water heater decreases in aproximately 3% —which is not yet a harmful level to the human being—the pilot flame 23 moves away from the thermocouple 24, cooling it down, thus deactivating the solenoid cut-off valve 3 and interrupting the flow of gas to the burner to turn-off the burner flames as well as the pilot flame 23. The water heater is automatically turned-off in a fail-safe condition and can not be turned on again until the user manually starts the lighting cycle and simultaneously the oxygen level around the heater has returned to a normal level.

In this manner the possibility of intoxication or suffocation of the user in operating the water heater in an ambient without proper ventilation is completely eliminated.

Figure 4:
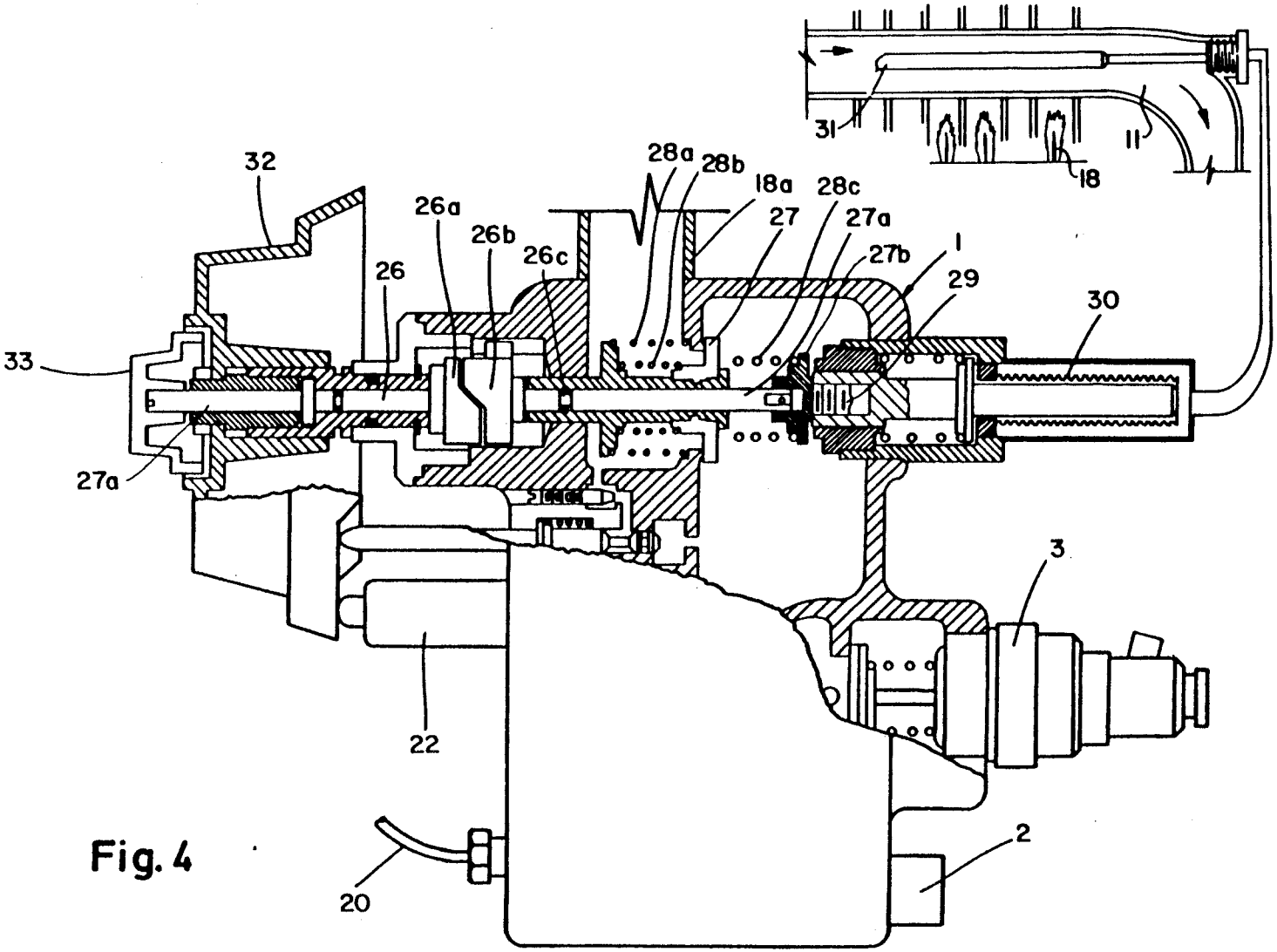
FIG. 4 schematically illustrates the linear arrangement on a single axis interconnecting the manual opening/closing control of the main control valve, the thermostatic knob, the actuator mechanism, and the thermostatic actuator.

FIG. 4 illustrates the improvement in the design of the body of the main gas flow valve 1, only the upper part of which is shown. The improvement comprises the concentrical linear arrangement of the main control knob shaft 26 of the main valve control knob 32 of the gas valve 1, and the thermostat knob 33. The assembly of the resilient main gas on-off control and modulating disc valve 27 and the thermostatic actuator of the water temperature control are activated through the thermostatic setting spring **28*c*, the inside spring 28*b*, and the outside spring 28*a*. When the thermostat knob 33 is manually rotated a certain distance between the main gas modulating valve 27 and the thermostatic setting 27*b* is set due to the thermostatic actuator 30 which acts over spring 28*c*, the thermostatic setting 27*b* is forced to advance when the temperature raises, thus reducing the gas flow to the main burner 18 through the main gas modulating valve 27. This also means that the slide of the main gas modulating valve 27** due to temperature variation, causes a different amount of gas to flow to the burner, modulating in this way the burner's flame. This is the reason why this is a gas modulating valve.

The water temperature regulation knob 33 is a concentric location with the main valve control knob 32. When the water temperature setting knob 33 is manually rotated the thermostatic setting rod 27*a* also rotates inlaid the threaded thermostatic actuator head 29, screwing or unscrewing it thus shortening or enlarging the distance between the actuator 30, which is connected to the thermostatic sensor 31 located inside the heating coil 11 of the water heater and the main gas modulating valve 27, thus determining the automatic thermostatic temperature setting range of the hot water delivered by the instantaneous water heater.

In the case that the thermostat device is not installed, a threaded metallic stopper is installed instead, with an equivalent thread to the thermostatic actuator head. The regulation of water temperature under this condition is performed only by manually rotating the water temperature setting knob 33 thus predetermining the fixed amount of gas flow to the burner by setting the main gas valve 27.

On the other hand, the external end of the main control knob shaft 26 of the gas flow, and the inner end of said shaft is provided with a circular conductor cam 26*a* affixed to said shaft 26 so as to rotate in correspondence with the rotational movement of main valve control knob 32. A conducted complementary cam 26*b* separated from cam 26*a* is connected to a shaft 26*c* acting over the setting spring 28*a* on which is mounted a slidable, conventional resilient main gas on-off control and modulating valve 27 supported also by springs 28*b* and 28*c* one inside and the other outside, thus allowing the gas control flow to the burner 18.

For lighting the water heater main valve, the main valve control knob 32 should be set to the pilot position. Only in this position is it possible to push a safety actuator knob (not shown), opening manually the solenoid cut-off protector 3 and at the same moment making the piezoelectric device 22 to activate the spark plug 21, allowing to ignite the pilot flame 23.

Only after the pilot flame is ignited and the solenoid cut-off protector is activated, the user can rotate the main valve control knob 32 to the ON position.

It is important to mention that when the main valve control knob 32 is in the OFF position all the valve gas passages are hermetically closed.

It is evident to those skilled in the art that the teachings of the present invention can be applied even if modifications and/or changes in the elements and/or their arrangement either in the instantaneous water heater or in the gas valve are made, without departing from the scope and spirit of the invention.

I claim:

1. A gas control valve for an instantaneous water heater, the water heater including devices for regulating and controlling hot water temperature, devices for lighting a pilot flame, a burner, a heat exchanger and a heating coil, said control valve comprising:

a body, a settling chamber for separating gas entrained solid particles disposed in a lower portion of said body;

a temperature regulation knob coupled to said body;

a gas flow modulating valve coupled to said regulation knob;

a thermostatic actuator coupled to said modulating valve;

a temperature sensor operatively associated with said thermostatic actuator;

means for preventing explosion of the heat exchanger in event of excess heating of the water in the heating coil; and means for interrupting gas flow to the burner when ambient air around the water heater has an oxygen deficiency, said interrupting means being actuated by the pilot flame.

2. The gas control valve as claimed in claim 1, wherein a shaft of said regulation knob, an axial shaft of said modulating valve and an axial shaft of said thermostatic actuator are positioned in a linear and coaxial relationship.

3. The gas control valve as claimed in claim 1, wherein said gas flow modulating valve includes an aperture, setting a size of said aperture being controlled by a first cam mounted on a shaft of the gas control valve, said first cam actuating against a second complementary cam affixed to a body of said gas flow modulating valve.

4. The gas control valve as claimed in claim 1, wherein said explosion preventing means include a thermostatic sensor disposed in a hot water outlet side of the heating coil, said thermostatic sensor including a capillary tube which cooperates with an actuator, said actuator being mechanically coupled to an electric switch which is connected to a circuit for energizing a solenoid control valve.

5. The gas control valve as claimed in claim 1, wherein said gas flow interpreting means includes atmosphere analyzer means disposed in a pilot flame nozzle and a thermocouple, said thermocouple being heated by said pilot flame, said thermocouple generating a voltage to energize a solenoid control valve, the pilot flame moving outward of said analyzer means when the atmosphere is oxygen deficient so that said thermocouple cools down and said solenoid control valve is de-energized.

6. The gas control valve as claimed in claim 1, wherein said solid settling chamber includes a screen filter positioned upstream of an inlet gas passage controlled by a solenoid control valve.

7. A gas control valve for an instantaneous water heater, the water heater including devices for regulating and controlling hot water temperature, devices for lighting a pilot flame, a burner, a heat exchanger and a heating coil, said control valve comprising:

a body, a settling chamber for separating gas entrained solid particles disposed in a lower portion of said body;

a temperature regulation knob coupled to said body;

a gas flow modulating valve coupled to said regulation knob, said gas flow modulating valve including an aperture, setting a size of said aperture being controlled by a first cam mounted on a shaft of the gas control valve, said first cam actuating against a second complementary cam affixed to a body of said gas flow modulating valve;

a thermostatic actuator coupled to said modulating valve;

a temperature sensor operatively associated with said thermostatic actuator;

means for preventing explosion of the heat exchanger in event of excess heating of the water in the heating coil; and means for interrupting gas flow to the burner when ambient air around the water heater has an oxygen deficiency, said interrupting means being actuated by the pilot flame.

8. The gas control valve as claimed in claim 7, wherein a shaft of said regulation knob, an axial shaft of said modulating valve and an axial shaft of said thermostatic actuator are positioned in a linear and coaxial relationship.

9. The gas control valve as claimed in claim 7, wherein said explosion preventing means include a thermostatic sensor disposed in a hot water outlet side of the heating coil, said thermostatic sensor including a capillary tube which cooperates with an actuator, said actuator being mechanically coupled to an electric switch which is connected to a circuit for energizing a solenoid control valve.

10. A gas control valve for an instantaneous water heater, the water heater including devices for regulating and controlling hot water temperature, devices for lighting a pilot flame, a burner, a heat exchanger and a heating coil, said control valve comprising:

a body, a settling chamber for separating gas entrained solid particles disposed in a lower portion of said body;

a temperature regulation knob coupled to said body;

a gas flow modulating valve coupled to said regulation knob;

a thermostatic actuator coupled to said modulating valve;

a temperature sensor operatively associated with said thermostatic actuator;

means for preventing explosion of the heat exchanger in event of excess heating of the water in the heating coil; and means for interrupting gas flow to the burner when ambient air around the water heater has an oxygen deficiency, said interrupting means being actuated by the pilot flame, said gas flow interpreting means including atmosphere analyzer means disposed in a pilot flame nozzle and a thermocouple, said thermocouple being heated by said pilot flame, said thermocouple generating a voltage to energize a solenoid control valve, the pilot flame moving outward of said analyzer means when the atmosphere is oxygen deficient so that said thermocouple cools down and said solenoid control valve is de-energized.

11. The gas control valve as claimed in claim 10, wherein said explosion preventing means include a thermostatic sensor disposed in a hot water outlet side of the heating coil, said thermostatic sensor including a capillary tube which cooperates with an actuator, said actuator being mechanically coupled to an electric switch which is connected to a circuit for energizing a solenoid control valve.

12. The gas control valve as claimed in claim 10, wherein a shaft of said regulation knob, an axial shaft of said modulating valve and an axial shaft of said thermostatic actuator are positioned in a linear and coaxial relationship.

13. A gas control valve for an instantaneous water heater, the water heater including devices for regulating and controlling hot water temperature, devices for lighting a pilot flame, a burner, a heat exchanger and a heating coil, said control valve comprising:

a body, a settling chamber for separating gas entrained solid particles disposed in a lower portion of said body, said solid settling chamber including a screen filter positioned upstream of an inlet gas passage controlled by a solenoid control valve;

a temperature regulation knob coupled to said body;

a gas flow modulating valve coupled to said regulation knob;

a thermostatic actuator coupled to said modulating valve;

a temperature sensor operatively associated with said thermostatic actuator;

means for preventing explosion of the heat exchanger in event of excess heating of the water in the heating coil; and means for interrupting gas flow to the burner when ambient air around the water heater has an oxygen deficiency, said interrupting means being actuated by the pilot flame.

14. The gas control valve as claimed in claim 13, wherein a shaft of said regulation knob, an axial shaft of said modulating valve and an axial shaft of said thermostatic actuator are positioned in a linear and coaxial relationship.

15. The gas control valve as claimed in claim 13, wherein said explosion preventing means include a thermostatic sensor disposed in a hot water outlet side of the heating coil, said thermostatic sensor including a capillary tube which cooperates with an actuator, said actuator being mechanically coupled to an electric switch which is connected to a circuit for energizing a solenoid control valve.

* * * * *